United States Patent [19]

Achenbach

[11] 4,216,740

[45] Aug. 12, 1980

[54] DEVELOPING DEVICE FOR DEVELOPING ELECTROSTATIC IMAGES WITH A MAGNETIC BRUSH

[75] Inventor: Karlheinz Achenbach, Kaufbeuren, Fed. Rep. of Germany

[73] Assignee: Olympia Werke AG, Wilhelmshaven, Fed. Rep. of Germany

[21] Appl. No.: 914,151

[22] Filed: Jun. 9, 1978

[30] Foreign Application Priority Data

Jun. 10, 1977 [DE] Fed. Rep. of Germany ..... 2726209

[51] Int. Cl.[2] ..... G03G 15/09

[52] U.S. Cl. ..... 118/681; 118/708; 118/657

[58] Field of Search ..... 118/658, 653, 247, 708, 118/681, 657

[56] References Cited

U.S. PATENT DOCUMENTS

| | | | |
|---|---|---|---|
| 1,900,121 | 3/1933 | Manvell | 118/247 |
| 3,078,821 | 2/1963 | McEwen | 118/708 |
| 3,145,122 | 8/1964 | Streich | 118/658 |
| 3,207,050 | 9/1965 | Limberger | 355/11 |
| 3,450,093 | 6/1969 | Gugolz | 118/708 |
| 3,641,969 | 2/1972 | Hakanson | 118/658 |
| 3,872,829 | 3/1975 | Rattin | 118/658 |
| 4,126,100 | 11/1978 | Nishihama | 118/658 |

*Primary Examiner*—Roland E. Martin, Jr.
*Assistant Examiner*—John L. Goodrow
*Attorney, Agent, or Firm*—Spencer & Kaye

[57] ABSTRACT

In a device for developing electrostatic charge images produced on the surface of a sheet of electrophotographic recording material in a copier which employs a magnet having on its surface a magnetic brush formed of magnetizable toner particles, the copier further presenting a recording material sheet guide path which extends at a distance from the magnetic brush, there are provided contact elements which are disposed in the guide path and which are arranged to be controlled by the leading edge of a sheet of recording material in a manner to be brought into contact with the sheet along a line which lies behind its leading edge to press the recording material against the magnetic brush, the contact elements being controlled in a manner such that they are lifted away from the sheet shortly before reaching the trailing edge thereof in order to prevent the contact elements from contacting the magnetic brush.

9 Claims, 4 Drawing Figures

FIG. 1

FIG. 2

DEVELOPING DEVICE FOR DEVELOPING ELECTROSTATIC IMAGES WITH A MAGNETIC BRUSH

BACKGROUND OF THE INVENTION

The present invention relates to a device for developing electrostatic charge images produced on the surface of an electrophotographic recording material in a copier which employs a magnet having on its surface a magnetic brush formed of magnetizable toner particles, the copier further presenting a recording material guide path which extends at a distance from the magnetic brush.

In such devices, the sheet-like recording material is brought to the magnetic drum and must be guided so that the developing will be uniform. In some devices the recording material is brought into sliding contact with the magnetic brush, as disclosed, for example, in German Auslegeschrift [Published Application] No. 1,472,997. Guide surfaces in the known arrangement prevent the leading edge of the recording material from entering into the developer, but it is not possible to achieve uniform control of the pressure with which the recording material is pressed against the magnetic brush.

The guide surfaces of this arrangement are formed by curved guide elements which, because they are stiff and unyielding, must be installed accurately. In particular, they must be installed so that the gap between the guide plane and the magnetic brush is set in a precise manner. If this gap is too small, the guide elements may be soiled by contact with developer particles or due to electrostatic attraction of such particles, which particles may then adhere to the back of the recording material and soil it. If the gap is too large, the pressure with which the recording material is pressed against the magnetic brush is insufficient.

This known arrangement does not include any means for adjusting the gap between the recording material and the magnetic brush. Such adjustment may be necessary if different types of toners are employed because the thickness of the magnetic brush which is held by the magnetic drum depends on the magnetizability of the respective toner.

SUMMARY OF THE INVENTION

It is an object of the present invention to provide a developing device of the above-described type in which the recording material is pressed against the magnetic brush with a uniform contact pressure.

A further object of the invention is to avoid soiling of the back of the recording material.

These and other objects are achieved according to the invention by providing a device of the above-described type with contact elements disposed in the guide path and arranged to be controlled by the leading edge of a sheet of recording material in a manner to be brought into contact with the recording material along a line which lies behind the leading edge, when viewed in the material transporting direction, to press the recording material against the magnetic brush, and the contact elements being arranged to be lifted away from the recording material shortly before reaching the trailing edge thereof in a manner to prevent the contact elements from contacting the magnetic brush.

The arrangement according to the invention assures that the pressure with which the recording material is pressed against the magnetic brush is always the same. According to a preferred embodiment of the invention, the contact elements are made of a nonmagnetic and antistatic material, which helps to prevent soiling of the back of the recording material sheets. According to a preferred embodiment the pressing elements are brought into the operating position by the recording material itself. Control of the contact elements is effected with simple and inexpensive means.

In the last mentioned preferred embodiment of the invention, the contact elements are mounted to be pivotal about an axis disposed at a guide sheet and are each constituted by one arm of a respective one of several two-armed contact levers, the levers having a starting position in which the other arm of each lever extends into the guide path and an active position in which the other arm is pivoted out of the guide path by the leading edge of a recording material sheet to cause the one arm of each lever to enter the guide path and press the sheet against the magnetic brush.

DESCRIPTION OF THE PREFERRED EMBODIMENTS

Figure 1:
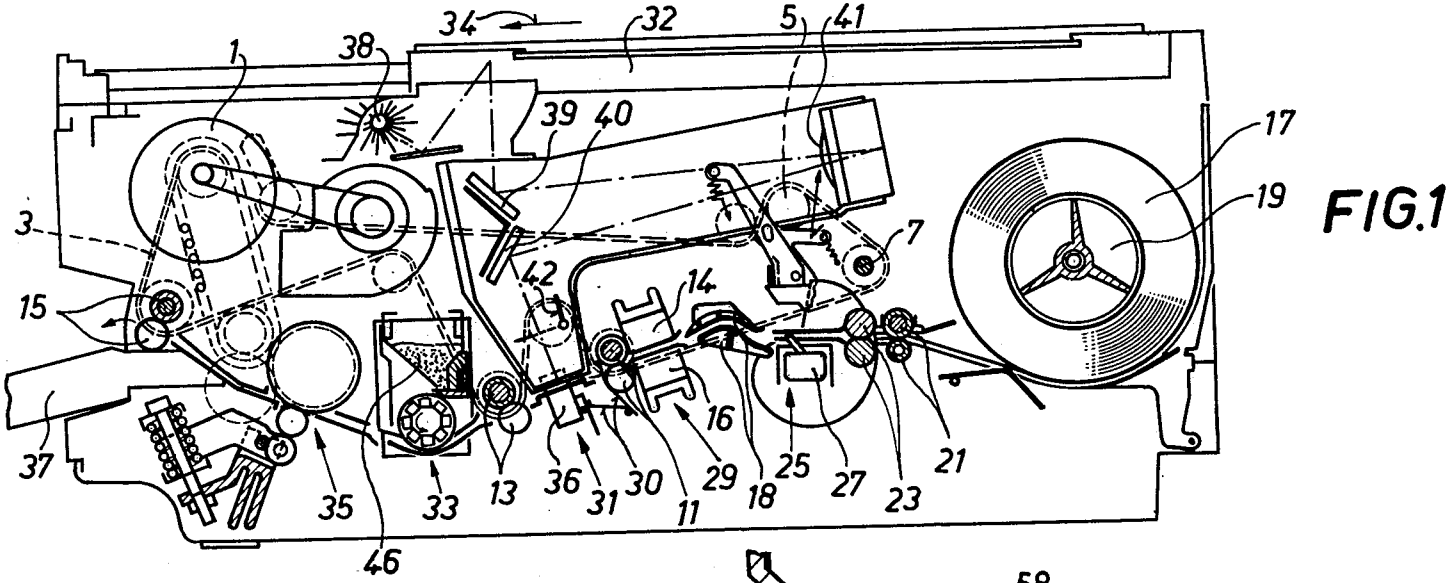
FIG. 1 is a cross-sectional elevational view of a copying device of the type in which the present invention can be used.

FIG. 1 shows an electrophotographic copier which includes a geared motor 1 connected to drive, via a toothed belt 3, a main drive shaft 7, a gear drive wheel 5 for a reversing gear (not shown), pairs of transporting rollers 11 and 13, and a pair of ejection rollers 15. A roll of photosensitive recording sheet material 17 is disposed on a rotatably mounted supply roller 19 and the leading edge of this recording material is placed between intake rollers 21 when a new roll is placed into the machine. Upon actuation of a start key or button (not shown) disposed on the top of the machine, the recording material is pulled by intake rollers 23 into a cutting device 25, where the sheet material operates a switch 27 to initiate the copying process. The recording material 17 passes over a loop former 18 into a charging station 29 where it is electrostatically charged in a known manner from coronas 14 and 16. Directly behind the coronas 14 and 16, the recording material 17 is gripped by transporting rollers 11 and transported in the direction of an illumination, or exposure, station 31. On its way to station 31, the leading edge of the sheet of recording material 17 actuates a switch 36 via rods 30 so that a carriage 32 with the sample to be copied starts to move in direction 34 at the instant when the sheet of recording material enters the station 31.

The speed of advance of carriage 32 is the same as the speed of advance of the sheet of recording material 17. With this synchronous movement it is assured that a true-to-the-original image of the sample to be copied is produced on the recording material 17. The path of light from the copier lamp 38 via deflector mirrors 39 and 40 and mirror lens 41 is indicated by a dot-dash line.

The quantity of light can be influenced by means of an aperture 42. In this way, a latent image of the original is produced on the recording material 17.

Downstream of the illumination station 31, the transporting rollers 13 transport the recording material 17 into the developer station 33. After development of the charge images produced on the surface of the recording material 17, the recording material 17 moves to a fixing station 35 and from there via ejection rollers 15 into a depository 37.

Figure 2:
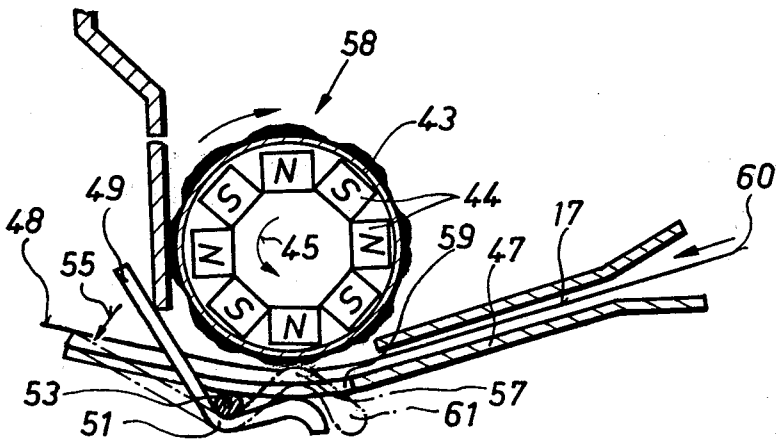
FIG. 2 is a detail view of the device of FIG. 1, to an enlarged scale, illustrating a first preferred embodiment of the invention.

The developer station 33 is a magnetic brush station which includes, as shown in FIG. 2, a magnetic roller composed of a stationary aluminum tube 43 with a continuously rotating permanent magnet 44 mounted in its interior. Magnet 44 presents poles of circumferentially alternating polarity. On the surface of the aluminum tube 43, toner particles travel around the aluminum tube circumference in a direction opposite to the direction of rotation of magnet 44 and due to the continuing changes of the magnetic field polarity, stand up in the manner of a brush. The portions of the surface of recording material 17 which are charged, for example, with a negative charge, can thus very directly receive toner particles from the magnetic roller, thereby developing the latent charge image. The toner taken over by the magnetic roller is continuously replenished from a reservoir 46 disposed above the magnetic roller.

Upon introduction of its leading edge 48 into the developer station 33, the sheet of recording material is held at a certain distance from the magnetic roller by a metal guide sheet 47. During further transport of the sheet, leading edge 48 comes to abut against arms 49 of pressure levers 51, which are mounted to pivot about axis 53, and pivots these levers in the direction of the arrow 55 from the position shown in solid lines to the position shown in dot-dash lines. Second arms 57 of the contact levers 49 are then brought into contact with the back of the sheet of recording material 17 and press it against the magnetic brush of the magnetic roller 58. The pressure levers 51 thus act as pressing elements. Axis 53 is fixed to the machine frame, and the levers are aligned with one another perpendicular to the plane of FIG. 2, so that only one of them is visible in FIG. 2.

Axis 53 is disposed in the region of the guide sheet 47, which is designed to act as a guide surface, and arms 49 and 57 are pivotal through openings 59 provided in this guide sheet 47. Contact levers 51 and the associated openings 59 are arranged parallel to and at uniform distances from the magnetic drum 58.

As soon as the trailing edge 60 of the sheet of recording material 17 has left the lowest point of the magnetic drum 58, contact levers 51 pivot back to their starting position shown in solid lines in FIG. 2. This pivoting back of the contact levers 51 occurs by the action of weights 61 disposed at the ends of arms 57. It is of course also possible, within the scope of the present invention, to effect such setting back by resetting springs appropriately articulated to contact levers 51. Resetting of contact levers 51 must occur shortly before the trailing edge 60 reaches them. In the work position (shown in dot-dash lines in FIG. 2) the arms 57 of the contact levers 51 don't contact the magnetic brush of the magnetic roller 58. The spacing between the magnetic brush and the contact levers 51 is then a few 1/100 mm smaller than the thickness of the recording material. Thus the arms 57 of contact levers 51 are prevented from coming into direct contact with the magnetic brush of magnetic drum 58 so that arms 57 cannot be soiled.

Soiling of contact levers 51 by toner particles which might drop from magnetic drum 58 is prevented by making the contact levers 51 of a nonmagnetic and antistatic material such as an alloy of aluminum and manganese. Any toner particles which may have dropped pass through openings 59 into a vessel 62 disposed vertically below the magnetic roller 58 to recover the developer powder.

In order to assure uniformly light contact by the contact levers 51 which are disposed parallel to and at uniform distances along the length of magnetic drum 58, the second arms 57 are made resilient.

Figure 3:
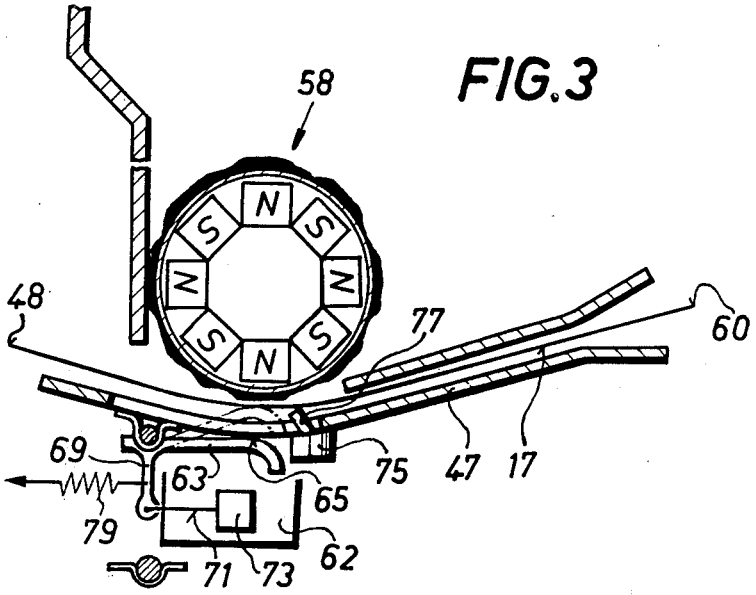
FIG. 3 is a view similar to that of FIG. 2 illustrating a second preferred embodiment of the invention.
Figure 4:
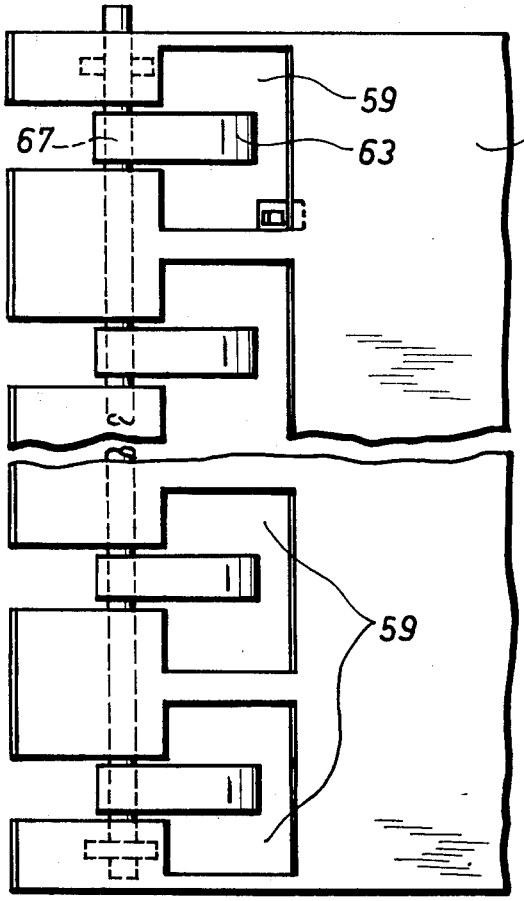
FIG. 4 is a top plan view of several components of the structure of FIG. 3.

FIGS. 3 and 4 show a second embodiment of the invention in which the contact elements 63 are constituted by laminated resilient leaf springs with curved free ends 65 which press the recording material 17 against the magnetic brush of magnetic drum 58. The leaf springs 63 are firmly connected with a shaft 67 which is pivotally mounted at guide sheet 47. This shaft 67 has a vertical arm 69 which is positively connected via a connecting member 71 with an electromagnet or solenoid 73 that acts as a control member. This electromagnet 73 is controlled by a sensing switch 75 whose actuating member 77 extends into the guide path of the recording material 17. The actuating member 77 of switch 75 is initially deflected by the leading edge 48 of a sheet 17 and then returns to its rest position after passage of the trailing edge 60 thereof, so that the leaf springs 63 can initially be brought into contact with the sheet of recording material 17 along a line which lies behind the leading edge 48 when seen in the sheet transporting direction and can be pivoted away from the recording material 17 shortly before the trailing edge 60 of the recording material 17 passes the lowest point of drum 58 so that the leaf springs 63 will not come into contact with the magnetic brush of the magnetic drum 58. The leaf springs 63 which are acted on by electromagnet 73 also permit the recording material to be pressed lightly against the magnetic brush of the magnetic drum 58. Resetting of shaft 67 and of leaf springs 63 to their solid line, rest state is effected by the force applied by a resetting spring 79. The resilient leaf springs are again made of a nonmagnetic and antistatic material such as an alloy of aluminum and manganese. In the work position (shown in dot-dash lines of FIG. 2) the resilient leaf springs 63 don't contact the magnetic brush. The spacing between the magnetic brush and the leaf springs 63 is then a few 1/100 mm smaller than the thickness of the receiving material.

Still within the scope of the present invention, the contact elements may also be designed differently, it being important that they press the recording material 17 against the magnetic brush of the magnetic drum 58 with light pressure in order to permit uniform development of the charge images produced on the surface of the recording material 17. The arrangement according to the invention is particularly suited for magnetic drums having an external coating of an electrically insulating material and employing magnetizable, electrically nonconductive toners.

It will be understood that the above description of the present invention is susceptible to various modifications, changes and adaptations, and the same are intended to be comprehended within the meaning and range of equivalents of the appended claims.

What is claimed is:

1. In a device for developing electrostatic charge images produced on the surface of a sheet of electrophotographic recording material in a copier which employs a magnet having on its surface a magnetic brush formed of magnetizable toner particles, the copier further presenting a recording material sheet guide path which extends at a distance from the magnetic brush, and along which such a sheet of recording material is advanced to effect development, the improvement comprising contact elements disposed in the vicinity of said guide path and associated with means arranged to be controlled by the leading edge of such a sheet of recording material for bringing said contact elements into contact with such sheet of recording material along a line which lies behind the leading edge of such sheet, when viewed in the direction of its advance along said guide path, to press such sheet against the magnetic brush, and arranged to lift said contact elements away from such sheet shortly before the trailing edge of such sheet reaches said elements, thereby to prevent said contact elements from contacting the magnetic brush.

2. An arrangement as defined in claim 1 wherein said contact elements are made of a nonmagnetic and antistatic material.

3. An arrangement as defined in claim 1 wherein said device includes a guide sheet delimiting said guide path and comprising two-armed levers pivotal about an axis located at said guide sheet, one arm of each said lever constituting a respective contact element and the other arm of each said lever constituting a part of said means, each said other arm being oriented to normally extend into said guide path and to be moved out of said guide path by engagement with the leading edge of a sheet of recording material advancing along said guide path in order to cause said one arm of each said lever to press such sheet against the magnetic brush.

4. An arrangement as defined in claim 3 wherein said means further comprise weights each connected to said one arm of a respective lever for producing a force which causes each said one arm to move away from the magnetic brush when the trailing edge of such sheet of recording material reaches the region of the magnetic brush.

5. An arrangement as defined in claim 3 wherein said means further comprise springs connected to urge said one arm of each said lever away from the magnetic brush.

6. An arrangement as defined in claim 3 wherein said one arm of each said lever is constituted by a resilient member.

7. An arrangement as defined in claim 1 wherein said device includes a guide sheet delimiting said guide path and provided with openings for passage of said contact elements, each said contact element is constituted by a resilient, laminated leaf spring, and said means comprise: a shaft to which said springs are fixed, said shaft being mounted to rotate for moving said springs between a starting position in which they are spaced from the magnetic brush and an active position in which they move through the openings in the guide sheet and press a sheet of recording material against the magnetic brush; and a control member connected for pivoting said shaft to move said springs to their active position.

8. An arrangement as defined in claim 7 wherein said control member comprises an electromagnet and a component movable in response to energization of said electromagnet and secured to said shaft, and said means further comprise a switch provided with an actuating member disposed in said guide path to respond to passage of a sheet of recording material, said switch being connected to supply energizing current to said electromagnet during response of said actuating member to passage of such a sheet for causing said leaf springs to press such sheet against the magnetic brush while assuring that said springs do not directly contact the magnetic brush.

9. An arrangement as defined in claim 7 further comprising a vessel for recovering toner powder provided below said openings in said guide sheet vertically below the magnetic brush.

* * * * *

UNITED STATES PATENT AND TRADEMARK OFFICE

CERTIFICATE OF CORRECTION

PATENT NO. : 4,216,740

DATED : August 12, 1980

INVENTOR(S) : Karlheinz Achenbach

It is certified that error appears in the above—identified patent and that said Letters Patent is hereby corrected as shown below:

The title page should be deleted to appear as per attached.

Column 4, line 51, change "receiving" to --recording--.

Signed and Sealed this

Seventeenth Day of March 1981

[SEAL]

*Attest:*

RENE D. TEGTMEYER

*Attesting Officer*

*Acting Commissioner of Patents and Trademarks*

United States Patent [19]

Achenbach

[11] 4,216,740

[45] Aug. 12, 1980

[54] DEVELOPING DEVICE FOR DEVELOPING ELECTROSTATIC IMAGES WITH A MAGNETIC BRUSH

[75] Inventor: Karlheinz Achenbach, Kaufbeuren, Fed. Rep. of Germany

[73] Assignee: Olympia Werke AG, Wilhelmshaven, Fed. Rep. of Germany

[21] Appl. No.: 914,151

[22] Filed: Jun. 9, 1978

[30] Foreign Application Priority Data

Jun. 10, 1977 [DE] Fed. Rep. of Germany ..... 2726209

[51] Int. Cl.[2] ..... G03G 15/09

[52] U.S. Cl. ..... 118/681; 118/708; 118/657

[58] Field of Search ..... 118/658, 653, 247, 708, 118/681, 657

[56] References Cited

U.S. PATENT DOCUMENTS

| | | | |
|---|---|---|---|
| 1,900,121 | 3/1933 | Manvell | 118/247 |
| 3,078,821 | 2/1963 | McEwen | 118/708 |
| 3,145,122 | 8/1964 | Streich | 118/658 |
| 3,207,050 | 9/1965 | Limberger | 355/11 |
| 3,450,093 | 6/1969 | Gugolz | 118/708 |
| 3,641,969 | 2/1972 | Hakanson | 118/658 |
| 3,872,829 | 3/1975 | Rattin | 118/658 |
| 4,126,100 | 11/1978 | Nishihama | 118/658 |

*Primary Examiner*—Roland E. Martin, Jr.
*Assistant Examiner*—John L. Goodrow
*Attorney, Agent, or Firm*—Spencer & Kaye

[57] ABSTRACT

In a device for developing electrostatic charge images produced on the surface of a sheet of electrophotographic recording material in a copier which employs a magnet having on its surface a magnetic brush formed of magnetizable toner particles, the copier further presenting a recording material sheet guide path which extends at a distance from the magnetic brush, there are provided contact elements which are disposed in the guide path and which are arranged to be controlled by the leading edge of a sheet of recording material in a manner to be brought into contact with the sheet along a line which lies behind its leading edge to press the recording material against the magnetic brush, the contact elements being controlled in a manner such that they are lifted away from the sheet shortly before reaching the trailing edge thereof in order to prevent the contact elements from contacting the magnetic brush.

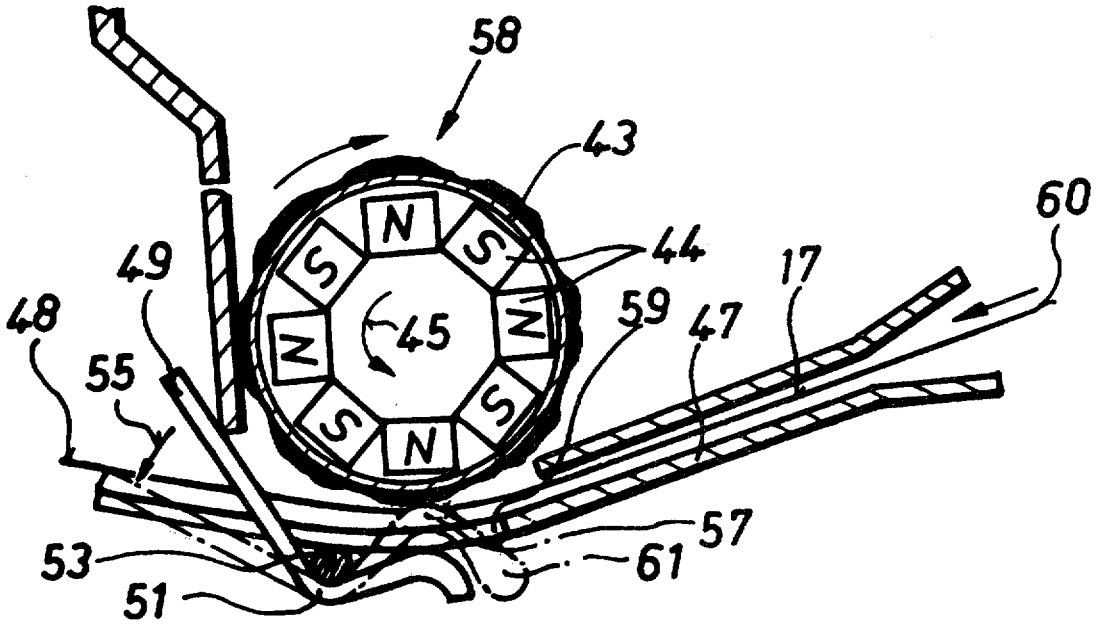

9 Claims, 4 Drawing Figures